United States Patent [19]

Canevall

[11] Patent Number: 4,701,280

[45] Date of Patent: Oct. 20, 1987

[54] PROCEDURE FOR PERMANENTLY STORING RADIOACTIVE MATERIAL

[76] Inventor: John Canevall, 19, Kungsholmsgatan, S-112 27 Stockholm, Sweden

[21] Appl. No.: 578,063

[22] PCT Filed: Jun. 9, 1982

[86] PCT No.: PCT/SE82/00202

§ 371 Date: Feb. 8, 1984

§ 102(e) Date: Feb. 8, 1984

[87] PCT Pub. No.: WO83/04455

PCT Pub. Date: Dec. 22, 1983

[51] Int. Cl.[4] ..... G21F 9/24

[52] U.S. Cl. ..... 252/633; 376/261; 376/272; 405/128; 52/169.6

[58] Field of Search ..... 376/272–276, 376/260, 261; 252/633; 52/741–743, 169.6, 169.11; 405/128

[56] References Cited

U.S. PATENT DOCUMENTS

| | | | |
|---|---|---|---|
| 3,608,636 | 9/1971 | Dixon | 376/274 |
| 3,706,630 | 12/1972 | Cohen et al. | 376/273 |
| 3,925,992 | 12/1975 | Backstrom | 376/273 X |
| 3,935,467 | 1/1976 | Gablin | 252/633 X |
| 4,171,921 | 10/1979 | Morfeldt | 252/633 X |
| 4,192,629 | 3/1980 | Hallenius et al. | 252/633 X |
| 4,244,153 | 1/1981 | Schwarzer et al. | 376/273 |
| 4,257,912 | 3/1981 | Fleischer et al. | 252/633 X |
| 4,326,820 | 4/1982 | Uerpmann et al. | 252/633 X |
| 4,375,930 | 3/1983 | Valiga | 405/128 |
| 4,377,509 | 3/1983 | Haynes et al. | 252/633 |
| 4,451,173 | 5/1984 | Watson et al. | 376/272 X |
| 4,453,857 | 6/1984 | Serra et al. | 405/128 |
| 4,481,165 | 11/1984 | Anderson et al. | 376/272 |
| 4,525,324 | 6/1985 | Spilker et al. | 376/272 |

FOREIGN PATENT DOCUMENTS

| | | | |
|---|---|---|---|
| 2713824 | 10/1978 | Fed. Rep. of Germany | 52/169.6 |
| 2856875 | 7/1980 | Fed. Rep. of Germany | 252/633 |

OTHER PUBLICATIONS

German 2,836,290, Abstract, Mar. 1979.

"Proceedings of the Third International Conference on the Peaceful Uses of Atomic Energy", Geneva, Binggeli et al, pp. 411–418, Sep. 1964.

"New Scientist", 10/30/80, p. 296.

*Primary Examiner*—Deborah L. Kyle

*Assistant Examiner*—Daniel Wasil

*Attorney, Agent, or Firm*—Banner, Birch, McKie & Beckett

[57] ABSTRACT

The invention provides for a procedure for permanently storing radioactive material in a rock chamber, comprising an enclosed construction (4) completely separated from the walls, floor and ceiling of the rock, made of permanent material impervious to water, in which materials in encapsulated (9) form are stored, and the outer spacing between the walls, ceiling and floor of the rock and the construction is completely filled with material not impervious to water (5). In the invention, the encapsulated material is placed inside the construction by means of a robot (10) on both sides of a track provided for the robot. When the construction is totally or partially filled with material, the construction or part of it containing material is sealed with bentonite or similar, leaving a passage (13) for the robot in the construction, which passage is filled with water-displacing material that is easy to dig. When the construction is completely filled, it is sealed up and the robot (10) is lifted up through a lift-shaft (3) connecting the construction with ground-level. The lift-shaft is sealed at least at the level of the construction and at ground-level.

6 Claims, 2 Drawing Figures

PROCEDURE FOR PERMANENTLY STORING RADIOACTIVE MATERIAL

Figure 1:
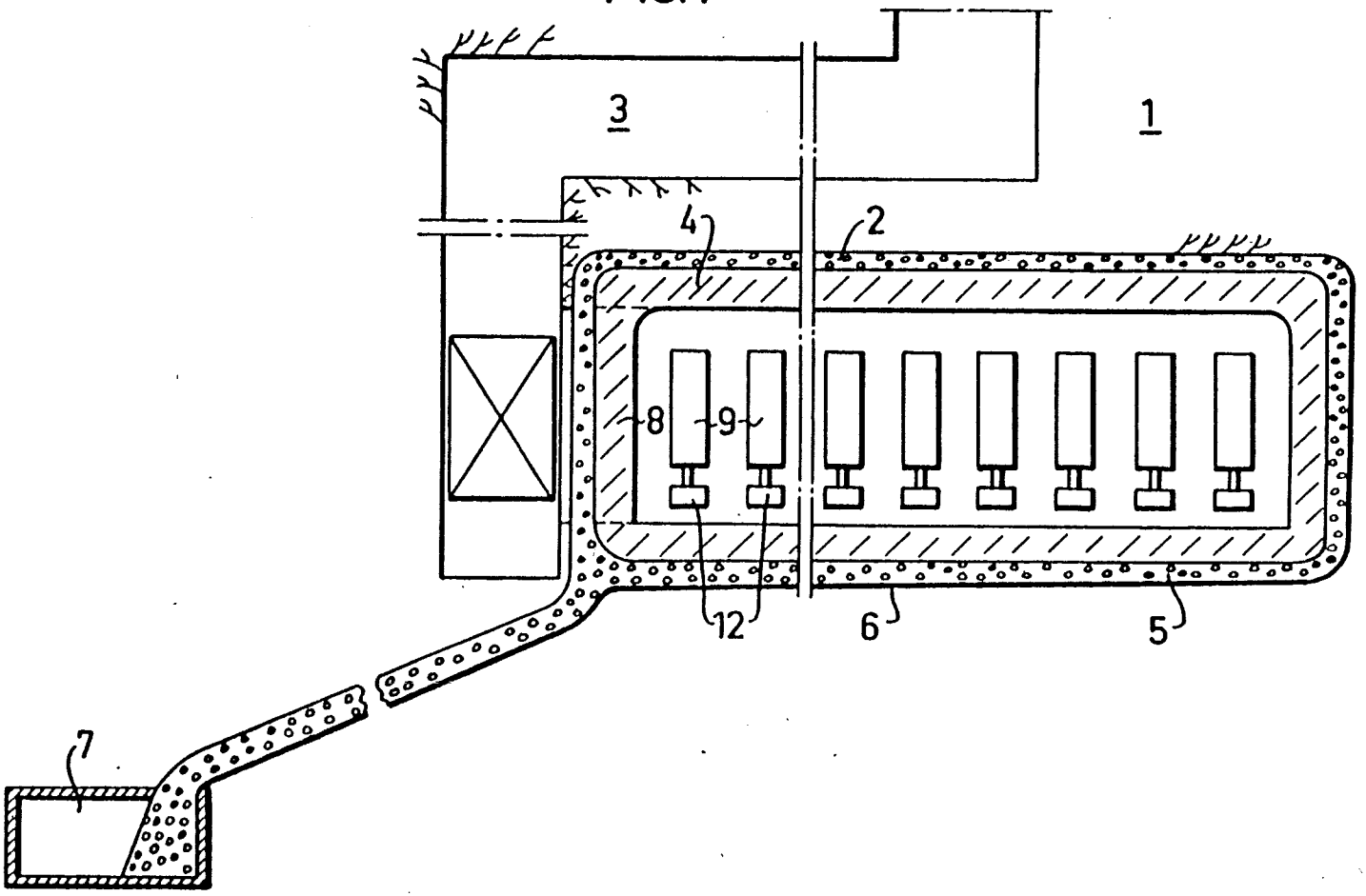

The invention provides for a procedure of permanently storing radioactive material in a rock chamber, and particularly for the permanent storage of used nuclear fuel from nuclear reactors and such radioactive waste as is formed by the production of used nuclear fuel (NAGIVA permanent storage).

Used nuclear fuel contains uranium, plutonium and fission-products, of which the uranium and the plutonium can be reprocessed and reused as fuel. However, it is not possible today to regain all the uranium and the plutonium, and during reprocessing, waste is formed, which contains, a large number of fission products, small amounts of uranium and plutonium and other transuranic elements. Most of the waste products are extremely radioactive.

Since strong radioactive radiation is dangerous to living organisms, it is necessary for the highly active waste to be stored away from such organisms for an extremely long time.

It has been suggested that the highly acitve waste be permanently stored under ground, at great depth under primary rock. Such a method of storage would bring about an effective protection from radioactive radiation. However, primary rock normally contains cracks and cavities and often also aquifers. The rock can also be subjected to deformations, for example from earthquakes. With this method of storage, therefore, there is a risk that such deformations of the bedrock can cause the waste containers stored in the rock to break open. Furthermore, there is the risk that the water in the subterranean streams will come into contact with the radioactive waste, which will then be able to spread without control. The radioactive decay also produces heat, causing convection currents in the subterranean streams.

In order to reduce the above-mentioned risks, a further method has been suggested in which the radioactive material is stored in a hollow body of solid material, which is placed in a hollow space inside a rock chamber. Such chamber has larger dimensions than the hollow body and the space between the outer casing of the body and the open space is filled with a plastic-deformable material. This space is in turn surrounded by a further, outer spacing surrounding the first space on all sides; this space must likewise be filled with a plastic-deformable material. The plastic material must have low permeability for water and must not split when deformed. The encapsulated material is stored freely within the hollow body for insertion and removal of the material and there are inspection-holes in the body for monitoring. However, this construction does not provides an effective permanent method of storage for all time, and, with its provision of several inspection shafts and the storage of material capsules lying freely inside the body, it can hardly be considered to fulfil the requirements for permanent storage, i.e. a period of thousands of years. This method would require considerable expense, both for construction and inspection.

The present invention, the characteristics of which are described in the patent claims, provides a method for permanent storage of radioactive material, which is both safe and requires no maintenance but which can, if so desired, be continuously inspected and allows any faults to be rectified.

Figure 2:
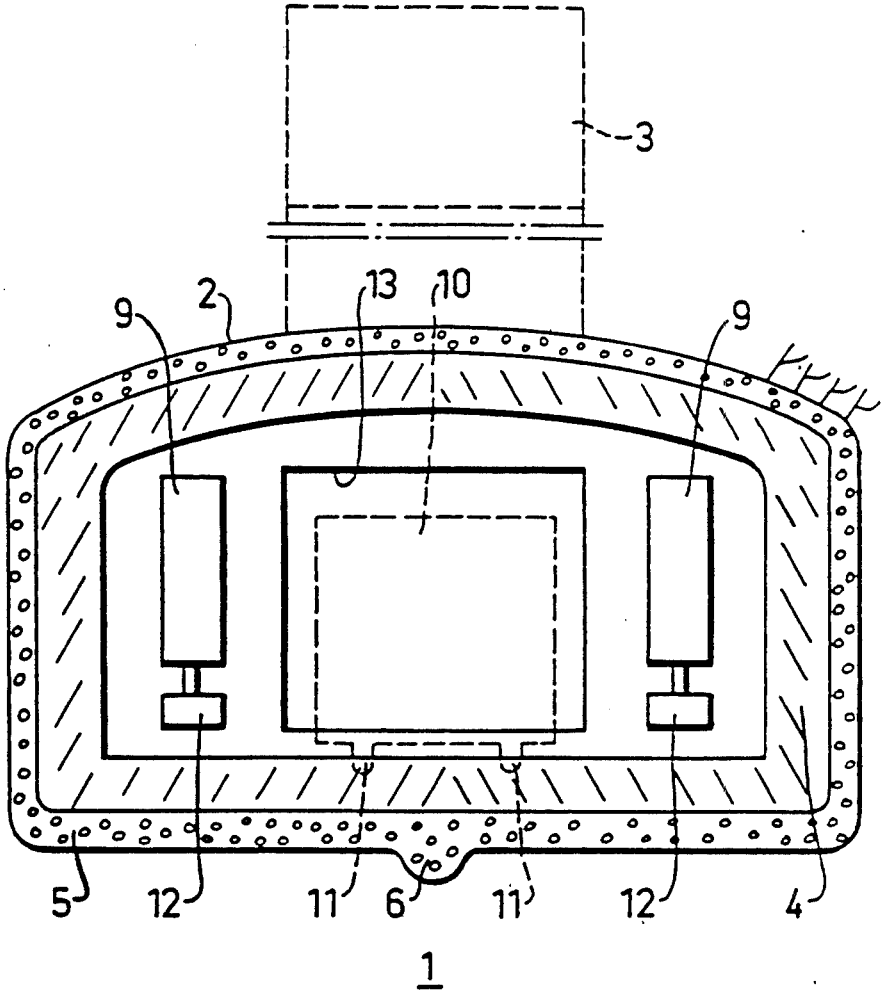

The invention will be described in greater detail in connection with an embodiment, with reference to the drawing, in which FIG. 1 shows a vertical section of a construction for carrying out the process and FIG. 2 shows the construction seen in a vertical section at right angles to the section of FIG. 1.

In the rock 1 there is incorporated a hollow space 2, which is connected to the surface (not shown) via a lift-shaft 3. The lift shaft 3 has one or more levels (one is shown in the drawing). Inside the hollow space 2 there is a hollow construction 4, the outside of which, with a space in between, is completely separated from the walls, ceiling and floor of the hollow space. Construction 4 consists of a permanent material impervious to water, and the interstice or the outer space between the walls of the hollow space and the construction, is filled with a material 5 which is non-impervious to water, for example shingle. In the example shown, the floor of the rock chamber is provided with a draining channel 6, which ends in a basin 7 at the end of the space. An opening 8, shown in FIG. 1 connects the lift-shaft 3 with the interior of construction 4.

We shall now describe how the invention provides for permanent storage of the encapsulated radioactive material.

Material capsules 9 transported through lift-shaft 3 down to the opening 8, where they are moved by a robot, indicated in FIG. 2, by the numeral 10, into construction 4 and placed at equal intervals in rows on either side of a track 11 for robot 10. Under each material capsule 9 there is collecting and checking vessel 12. The construction should preferably be filled with radioactive material starting from back. When the construction is filled with material capsules, the robot is taken out and raised up through the shaft 3 to ground level or any other suitable level. Then the construction is filled with filling material, for example bentonite, completely enclosing the capsules by means of e.g. channels or similar. Along the middle of the construction, enough space 13 is left for the robot, to enable it to move along the track.

If there is likely to be a long period of time between filling of encapsulated radioactive materials, the capsules leaded into the construction should at once be sealed into that part of the construction where they are positioned.

The track or passage 13 formed in the bentonite is filled in with a water-displacing material, which must, however, be easy to dig, for example shingle. When construction 4 is filled with material capsules, the construction filled out with bentonite, and the passage filled in with the water-displacing material, opening 8 is sealed up, filled out with material non-impervious to water in front of the opening, and the lower end of the lift-shaft is sealed up at the same height as the construction. The lift-shaft must also be sealed at ground and surface level and possibly at one or more places between.

If the construction lies in bed-rock above the level of the ground water, the surface water will be prevented from penetrating the completely water-impermeable construction, which is totally filled anyway, and therefore has no cavities that could collect water, and is fed instead in the water-permeable layer 5 down to basin 7. This can be provided with equipment of known principles enabling samples of the water to be taken from ground level in order to check on contamination from the radioactive material. If the construction is situated under the level of the ground water, basin 7 can be omitted and samples can be taken directly from layer 5, where the ground water will come to rest. But even in this case, it would be preferable to retain basin 7, since it would be thereby possible to collect the water surrounding construction 4, should this be necessary, by emptying basin 7 of the water coming to the basin from water-permeable layer 5.

The collecting and checking vessel 12 can likewise be checked in conventional fashion from ground-level with regard to radioactive radiation. As previously mentioned, the checking vessel can either moulded into the bentonite or made accessible from passage 13 and easily removeable for checking.

If a material capsule 9 should thus start to leak, this will not be observed until vessel 12 is checked, since this is where the leakage arrives first. If this primary means if checking has been missed or should prove impossible to carring out, there still remains the secondary chance of checking the radioactivity of the water flowing round or surrounding the outside of construction 4. Provisions must be made to allow water to be pumped up from basin 7 or outer room 5.

If a leakage is confirmed under a capsule 9 with, for example, the help of control vessel 12, and it is considered necessary to rectify fault, lift-shaft 3 is opened and the robot is lowered down to the construction. The robot breaks its way in through the closed-off opening of the construction, and digs its way forwards through passage 13 along track 11 until it reaches the leaking material capsule. From passage 13 the robot digs the capsule out from the bentonite and transports the capsule to lift-shaft 3. The capsule is transported thereafter through the tunnel to ground-level for further treatment. When it is considered suitable, whether the repaired capsule is returned to its original place with the aid of the robot or not, the interior of the construction is returned to its original condition and the lift-shaft is sealed off again.

From the above it will be seen that the invention provides for a permanent storage with secure barriers that provent the encapsulated radioactive material from coming into contact with water outside the external walls of the storage room. It should not be necessary to check the material, but there are simple and safe means of checking. There is no need for ventilation of the construction, and collecting-layer 5 serves for any necessary removal of heat. The layer will withstand relative movement between the rock wall and construction 4. Where suitable, a layer of elastic or plastic material can be placed inside construction 4, i.e. between it and the bentonite, in order to permit a certain movement between the construction and the bentonite, partly because of different coefficients of expansion in the materials.

Although the invention is described for use with a robot, it is of course possible to control the equipment manually.

The material capsules referred to may consist of conventional material approved by the authorities, and the form of the capsules for the material is such as to fulfil official requirement. The checking mechanisms for measuring the radioactivity of the water are also of types already familiar to technology and, as will be obvious, other measuring equipment can also used for measuring temperature on and inside the construction and for other purposes.

I claim:

1. A method of storing radioactive material in a hollow construction having an access opening, the construction being located below the surface of the ground within a rock chamber, said chamber having walls, a floor, and a ceiling; said construction being completely spaced from the walls, floor, and ceiling of the rock chamber to form an outer spacing, and said construction being made of material impervious to water, the construction comprising a capsule storage area and a capsule handling passageway adjacent thereto having a track and being connected to a lift-shaft running to the surface, the method including the steps of:

completely filling the outer spacing between the walls, ceiling, and floor of the rock chamber and the construction with material not impervious to water;

placing capsules containing the radioactive waste in encapsulated form into the capsule storage area;

filling the storage area around the loaded capsule with a sealing material to enclose the capsules;

repeating the placing and filling steps until the storage area has been completely filled in with the capsules and sealing material;

loading the passageway adjacent the storage area with a removable material different than the sealing material;

closing the construction and sealing the lift-shaft at least at the construction level and at ground level; and providing means for collecting any water penetrating into the outer spacing.

2. A method as in claim 1 wherein handling of the encapsulated radioactive material is carried out with the help of a robot, which is lifted up through the lift-shaft when the construction is filled.

3. A method as in claim 1 or 2, wherein the encapsulated material is placed in one or more rows along each side of the track.

4. A method as in claim 2 wherein when a fault in a material capsule is indicated, with undersired radioactive leakage as a consequence, the robot is lowered through the lift shaft and made to break its way into the construction and dig its way through the passage up to the faulty capsule, where the filling material is removed by the robot up to the capsule which is then transported by the robot to a place selected for any further treatment that may be required, and that the construction and the tunnel are filled up again and resealed when the leakage is considered to have been rectified.

5. A method as in claim 1 or 2 wherein an initial barrier is placed under the material capsule in the form of a checking vessel, in which any leakage from the capsule is collected, such leakage being indicated by a measuring device.

6. A method as in claim 1 or 2 wherein means is provided for checking the degree of purity of the water that has penetrated into the non-impervious material between the construction and the rock chamber as necessary by measuring instruments at ground level.

* * * * *